United States Patent [19]

Matsuda

[11] Patent Number: 4,858,447

[45] Date of Patent: Aug. 22, 1989

[54] WARP-KNIT TAPE FOR HOOK-AND-LOOP FASTENERS

[75] Inventor: Yoshio Matsuda, Toyama, Japan

[73] Assignee: Yoshida Kogyo K. K., Tokyo, Japan

[21] Appl. No.: 173,027

[22] Filed: Mar. 23, 1988

Related U.S. Application Data

[63] Continuation of Ser. No. 105,673, Oct. 8, 1987, abandoned.

[30] Foreign Application Priority Data

Oct. 8, 1986 [JP] Japan ..... 61-154573[U]
Oct. 8, 1986 [JP] Japan ..... 61-154574[U]

[51] Int. Cl.[4] ..... D04B 7/12

[52] U.S. Cl. ..... 66/191; 66/192; 66/193; 66/194

[58] Field of Search ..... 66/190–196

[56] References Cited

U.S. PATENT DOCUMENTS 4,338,800 7/1982 Matsuda ..... 66/196
4,463,486 8/1984 Matsuda ..... 66/196 X
4,677,011 6/1987 Matsuda ..... 66/194
4,709,562 12/1987 Matsuda ..... 66/194

FOREIGN PATENT DOCUMENTS 554152 9/1974 Austria .
561804 5/1975 Austria .
1189336 6/1985 Canada ..... 66/194
0091273 12/1983 European Pat. Off. .
1539997 9/1968 France .
55-38121 10/1980 Japan .
57381 1/1982 Japan .
62-29109 2/1987 Japan .

*Primary Examiner*—Ronald Feldbaum

[57] ABSTRACT

A warp-knit tape for hook-and-loop fasteners comprises a pile portion and selvage portions extending on opposite longitudinal edges thereof, the pile portion being constructed with pile threads, foundation threads and laid-in weft threads. The pile threads are knitted into a continuous chain of pile loops each having a rise portion and a horizontally extending flat portion and linking in interlaced relation with adjacent loops.

9 Claims, 5 Drawing Sheets

WARP-KNIT TAPE FOR HOOK-AND-LOOP FASTENERS

This is a continuation of application Ser. No. 105,673 filed Oct. 8, 1987, now abandoned.

BACKGROUND OF THE INVENTION

1. Field of the Invention

This invention relates to a hook-and-loop fastener comprising two layers of fabric which are releasably interengageable. One of the fabric layers carries hook- or mushroom-shaped male elements engageable with loop female elements on the other fabric layer. The present invention is concerned more particularly with the latter type of fabric which is formed by warp-knitting into a tape carrying thereon a multiplicity of pile-loops or female elements.

2. Prior Art

Numerous hook-and-loop fasteners commonly known as velvet clasp fastener or more recently termed "surface-type fasteners" have been introduced in the art. A typical hook-and-loop fastener having a warp-knit support tape structure is disclosed in Japanese Patent Publication No. 57-381, in which threads are formed into individual, discrete pile-loops extending over or between rows of stitches and aloof from a foundation web as shown in FIG. 5 of the accompanying drawings wherein the pile-loops are designated at P and the foundation web at F.

A similar warp-knit surface-type fastener tape is disclosed in Japanese Patent Publication No. 55-38121, which tape comprises warp threads, weft threads, pile-loop threads P and elastic threads E, as shown in FIG. 9 of the accompanying drawings. The elastic threads E serve to make the tape stretchable with pile-loops extending in floating relation to the foundation web in a manner similar to the tape disclosed in Japanese Patent Publication No. 57-381.

Both of the above prior art warp-knit female tapes have a common drawback in that since the pile-loops are independent one from another and kept in free disposition, they are prone to tilt or otherwise become deformed; that is, they fail to retain the desired shape and position that have been afforded upon fabrication of the tape, resulting in insufficient or defective coupling engagement with the hook elements on the mating male tape.

SUMMARY OF THE INVENTION

With the foregoing drawbacks of the prior art female or loop fastener tapes in view, the present invention seeks to provide an improved warp-knit female tape for a hook-and-loop fastener which is capable of retaining the shape and position best fit for its engagement with a male counterpart thereby providing a maximum of opportunity and strength of engagement of the loop elements with the hook elements on the respective tapes.

It is another object of the invention to provide an improved warp-knit female fastener tape which is capable of fullest engagement with its male counterpart even in stretched condition.

According to the present invention, a warp-knit tape for hook-and-loop fasteners comprises a pile portion constructed with pile threads, foundation threads and laid-in weft threads. The pile threads are knitted into a continuous chain of pile loops each having a rise portion and a horizontally extending flat portion and linking in interlaced relation with adjacent loops.

These and other objects and features of the invention will be better understood from the following detailed description taken in connection with the accompanying drawings which illustrate by way of example certain preferred embodiments of the invention.

DETAILED DESCRIPTION OF THE PREFERRED EMBODIMENTS

Figure 1:
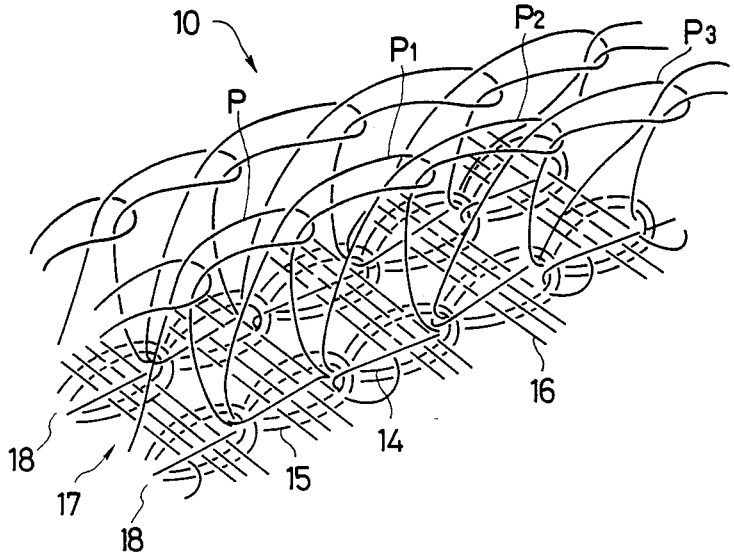
FIG. 1 is a diagrammatic perspective view of a warpknit loop or female fastener tape embodying the invention.

Referring now to the drawings and FIG. 1 in particular, there is shown on enlarged scale a warp-knit tape 10 to be used as a loop or female part of a hook-and-loop fastener. The system of the tape 10 is diagrammatically illustrated in FIG. 2 as consisting of a pile portion 11 and salvage portions 12 and 13 as extending longitudinally or warpwise on opposite edges of the pile portion 11 the tape system being formed suitably by a double Russel machine having front needles F and back needles B alternating over every other course.

Figure 3A:
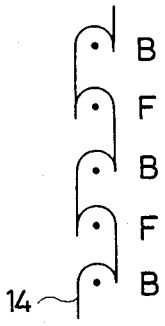
FIGS. 3*a*, 3*b* and 3*c* are schematic diagrams of individual stitches constituting the system of the warpknit tape of FIG. 1.
Figure 3B:
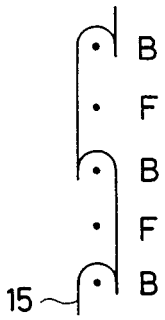
Figure 3C:
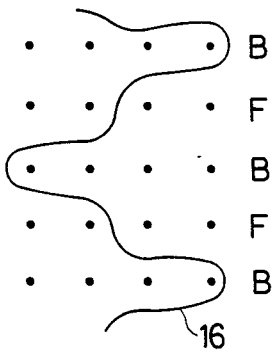
Figure 2:
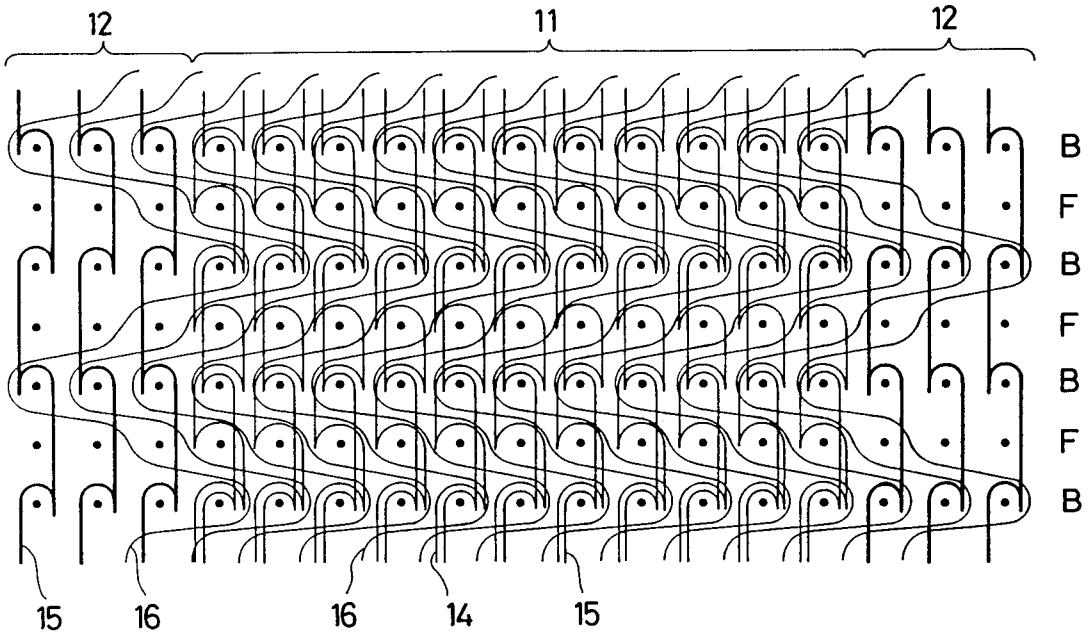
FIG. 2 schematically illustrates the construction of the warp-knit tape of FIG. 1.
Figure 4:
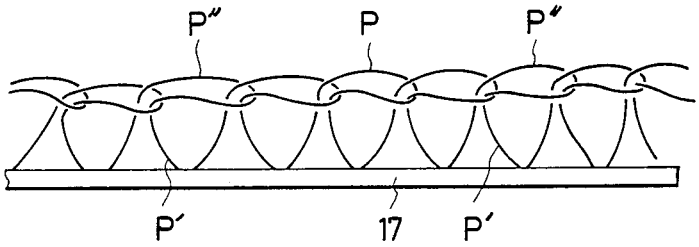
FIG. 4 is a schematic side elevational view showing the pile-loops of the tape.
Figure 5:
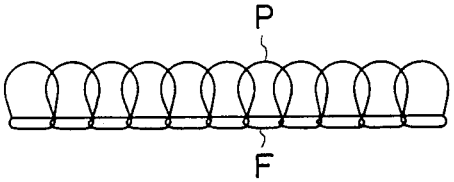
FIG. 5 PRIOR ART
FIG. 5 shows a prior art fastener tape.
Figure 6:
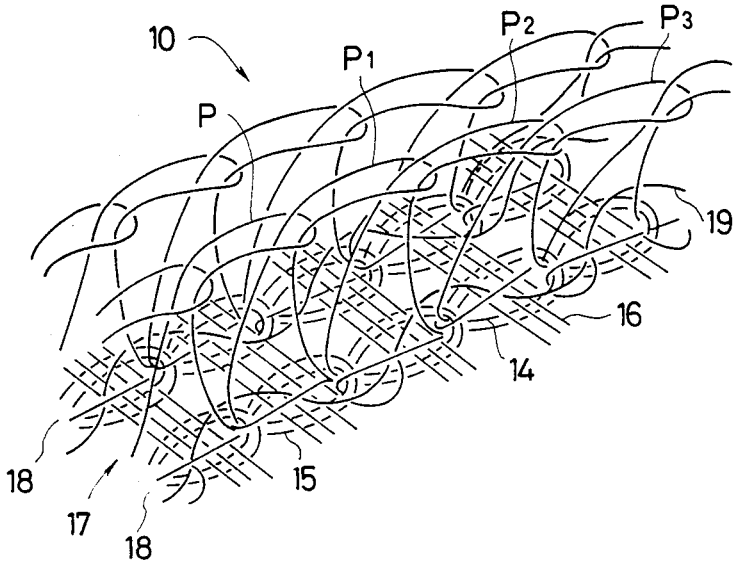
FIG. 6 is a diagrammatic perspective view of a modified form of warp-knit tape embodying the invention.

The pile portion 11 of the tape 10 shown in FIGS. 1 and 2 is constructed with pile threads 14 (FIG. 3*a*), foundation threads 15 (FIG. 3*b*) and laid-in weft threads 16 (FIG. 3*c*). The pile threads 14 are knitted in the form of chain stitches of Link No. 2-0/0-2/2-0/0-2 or Link No. 2-0/0-2/0-2/2-0 as shown in FIG. 3*a*. The pile threads 14 are knitted by back needles B together with weft threads 16 and foundation threads 15 to form a foundation web 17. The pile threads 14 are further knitted by front needles F into loops P of uniform size which are interlaced successively with ensuing loops P1, P2, P3 and so on to form a continuous chain of pile-loops extending over and along the wales 18 of the tape 10 as better shown in FIGS. 1 and 4, as a result of interlacing on intercrossing successive adjacent pile-loops P–P3, each of these pile-loops assumes substantially a form of double chain stitch having a rise portion P′ and a horizontally extending flat portion P″ and linking supportedly with adjacent pile-loops to provide a mechanically strong loop chain structure which is highly positionally stable and resistant to crushing out of shape.

The resulting pile-loops P–P3 are further protected against dislocation or pluck-out by the foundation web 17 of the tape 10 in which the stitches of pile threads 14 and foundation threads 15 are interlaced with weft threads 16 which are in turn urged into place by the sinker loops of foundation threads 15. This knit structure precludes the necessity of resin coatings over the reverse face of the tape which is otherwise applied to prevent the pile-loops from falling off.

Figure 7:
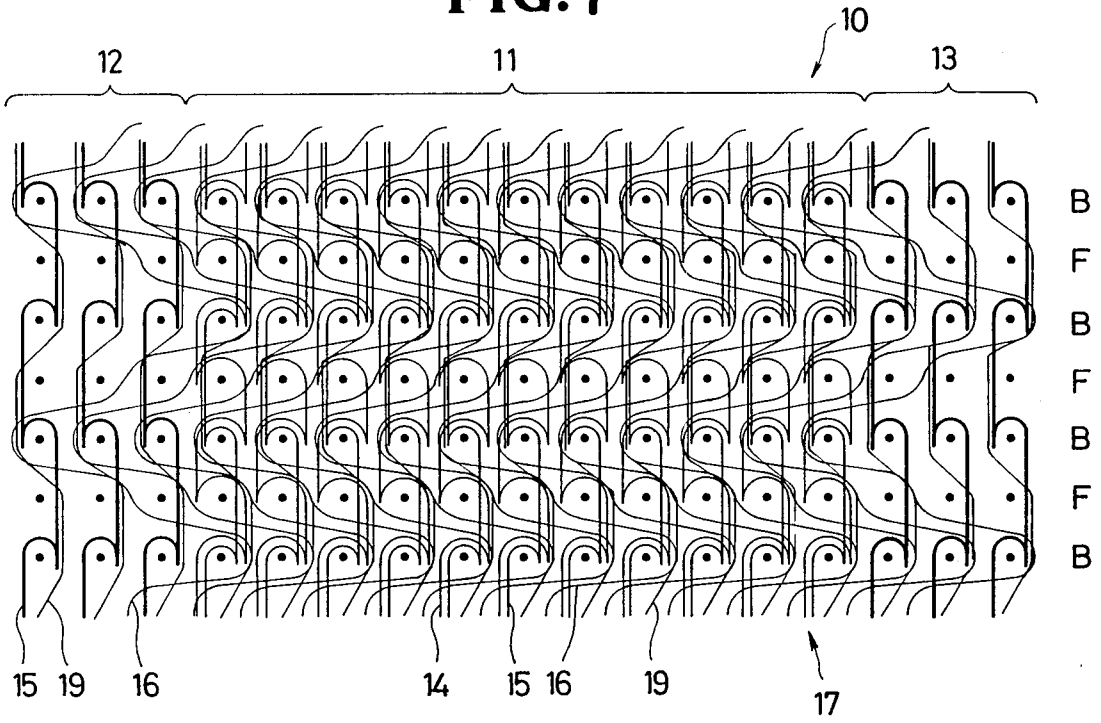
FIG. 7 is a schematic diagram of the construction of the tape in FIG. 6.
Figure 8A:
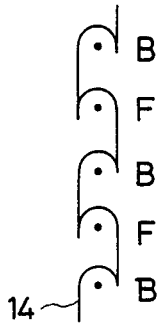
FIGS. 8*a*–8*d* are schematic diagrams of individual stitches constituting the system of the warp-knit tape of FIG. 6.
Figure 8B:
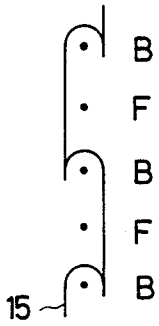
Figure 8C:
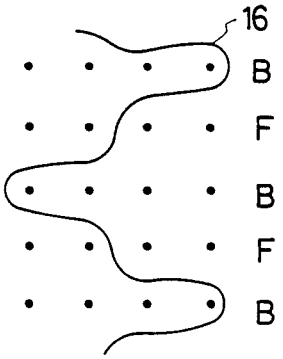
Figure 8D:
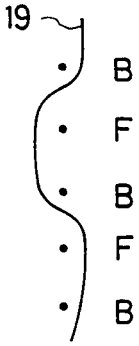
Figure 9:
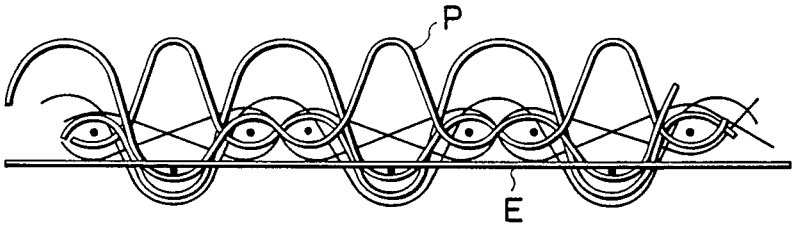
FIG. 9 PRIOR ART
FIG. 9 shows another prior art fastener tape.

FIGS. 6, 7 and 8*a*–8*d* inclusive show another embodiment of the invention which is identical to the first embodiment described above in connection with FIGS. 1–4 except for the use of elastic threads 19 to make the tape system 10 stretchable as a whole. Each of the elastic threads 19, which may be of a synthetic rubber, spandex and other covered yarn, is formed by idle-swing into a laid-in warp of Link No. 0-0/0-0/2-2/2-2 without being knitted into any stitch as shown in FIG. 8*d*. The elastic threads 19 may be laid in over each wale or every other wale, but should be stretched to some extent during knitting of the tape 10 and released upon take-off from the knitting machine to their original condition thereby holding the tape system shrunk as desired.

There may be used a crimped yarn for the foundation thread 15, if desired, to provide increased stretchability of the tape 10.

The selvages 12 and 13 extend over three wales on opposite longitudinal edges of the tape 10 as shown in FIGS. 2 and 7, and are adapted to be sewn or otherwise attached onto a garment article in a manner well known in the art. To prevent curl or deformation of the tape 10 along its selvages 12, 13, the latter may be thickened or reinforced further with chain stitches or tricot stitches.

Although various minor modifications may be suggested by those versed in the art, it should be understood that I wish to embody within the scope of the patent granted hereon, all such embodiments as reasonably and properly come within the scope of my contribution and art.

What is claimed is:

1. A warp-knit tape for hook-and-loop fasteners, comprising a pile portion constructed with pile threads, foundation threads and laid-in weft threads, said pile threads being knitted into a continuous chain of pile loops each having a rise portion and a horizontally extending flat portion and linking in interlaced relation with adjacent loops.

2. A warp-knit tape for hook-and-loop fasteners according to claim 1, wherein said pile threads are knitted in the form of chain stitches of Link No. 2-0/0-2/2-0/0-2.

3. A warp-knit tape for hook-and-loop fasteners according to claim 1, wherein stitches of said pile threads and stitches of said foundation threads are interlaced with said weft threads, said weft threads being urged into place by sinker loops of said foundation threads.

4. A warp-knit tape for hook-and-loop fasteners according to claim 1, further including elastic threads laid in said pile portion.

5. A warp-knit tape for hook-and-loop fasteners according to claim 4, wherein each of said elastic threads is a laid-in warp of Link No. 0-0/0-0/2-2/2-2.

6. A warp-knit tape for hook-and-loop fasteners according to claim 4, wherein said elastic threads extend in and along each wale at said pile portion.

7. A warp-knit tape for hook-and-loop fasteners according to claim 4, wherein said elastic threads extend in and along every other wale at said pile portion.

8. A warp-knit tape for hook-and-loop fasteners according to claim 4, wherein said foundation threads are crimped yarns.

9. A warp-knit tape for hook-and-loop fasteners according to claim 1, wherein said pile threads are knitted in the form of chain stitches of Link No. 2-0/0-2/0-2/2-0.

* * * * *